US011629491B1

(12) United States Patent
Meagher et al.

(10) Patent No.: US 11,629,491 B1
(45) Date of Patent: Apr. 18, 2023

(54) INTERCHANGABLE MODULAR CONSTRUCTION METHOD

(71) Applicants: Andrew Meagher, San Francisco, CA (US); Edison Rizon, Fairfield, CA (US)

(72) Inventors: Andrew Meagher, San Francisco, CA (US); Edison Rizon, Fairfield, CA (US)

(73) Assignee: Factory OS Inc.

( * ) Notice: Subject to any disclaimer, the term of this patent is extended or adjusted under 35 U.S.C. 154(b) by 0 days.

(21) Appl. No.: 17/220,682

(22) Filed: Apr. 1, 2021

(51) Int. Cl.
*E04B 1/348* (2006.01)

(52) U.S. Cl.
CPC ..... *E04B 1/34861* (2013.01); *E04B 1/34869* (2013.01); *E04B 2001/34892* (2013.01)

(58) Field of Classification Search
CPC ..... E04B 1/34861; E04B 1/34869; E04B 1/34807; E04B 1/34838; E04B 2001/34892
USPC ..... 52/79.9
See application file for complete search history.

(56) References Cited

U.S. PATENT DOCUMENTS

| | | | | |
|---|---|---|---|---|
| 7,827,738 | B2 | 11/2010 | Abrams et al. | |
| 8,001,730 | B2 | 8/2011 | Wallance | |
| 8,826,600 | B2 | 9/2014 | Wallance | |
| 9,213,785 | B2 | 12/2015 | Plewe | |
| 10,704,251 | B1 * | 7/2020 | Rubler | E04B 1/34815 |
| 10,908,593 | B1 | 2/2021 | Rizon et al. | |
| 2011/0056147 | A1 * | 3/2011 | Beaudet | E04B 1/34869 52/79.9 |
| 2011/0265396 | A1 * | 11/2011 | Heather | B65D 90/0026 52/79.9 |
| 2012/0266546 | A1 * | 10/2012 | Gyory | E04B 1/34384 52/126.1 |
| 2014/0013678 | A1 * | 1/2014 | Deverini | B29C 44/1233 52/79.1 |
| 2016/0312485 | A1 * | 10/2016 | Wilson | E04B 1/34807 |
| 2019/0186122 | A1 * | 6/2019 | Patterson | E04B 1/10 |
| 2019/0277020 | A1 * | 9/2019 | Ahern | F24F 7/065 |
| 2020/0040565 | A1 * | 2/2020 | Viehweg | E04B 1/34815 |
| 2020/0040594 | A1 * | 2/2020 | Hedberg | E04H 1/005 |

* cited by examiner

*Primary Examiner* — Paola Agudelo
(74) *Attorney, Agent, or Firm* — QuickPatents, LLC; Kevin Prince

(57) ABSTRACT

A modular building at a job site comprises one or more volumes templates, each comprising two or more core locations and a corridor all bounded within a volume footprint. A core for each core location is selected from a core catalog. Each core includes a base, at least three walls projecting upward from a floor of the base, a ceiling closing off an interior space, and an interior kit of internal walls, appliances, fixtures, and the like. Each volume template, the selected cores, and internal kits are constructed concurrently at a manufacturing facility along with external walls to complete each volume, which is transported to the job site. Adjacent volumes are connected together, with service lines of each core being connected with supply lines at the job site.

13 Claims, 10 Drawing Sheets

INTERCHANGABLE MODULAR CONSTRUCTION METHOD

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to construction, and more particularly to a modular building and construction method.

BACKGROUND

Volumetric modular construction refers to a construction technology and process in which at least certain processes are located in an "off-site" factory environment. The "off-site" terminology references the contrast to conventional construction in which the entirety of the building is constructed on its permanent site. In contrast, in many volumetric modular construction processes, most or even all of the "vertical" sections (e.g., apartment or other units and rooms) of a volumetric building are constructed in the factory, and shipped to the permanent site for building assembly. Certain "horizontal" sections (e.g., foundation, parking, etc.) may be built conventionally on the permanent site, and can be integrated with "vertical" sections constructed off-site. Other building elements (e.g., exterior siding, elevators or stairs) can also be built either off- or on-site. Generally, volumetric modular construction can entail thousands of materials delivered to the factory location for assembly during the fabrication process. The fabrication of a volumetric module entails thousands of manual and automated processes in an industrial designed assembly line setting. The labor component involves a multitude of construction disciplines (e.g., framers, electricians, plumbers, etc.). Instructions for materials and assembly are specific to each discipline, requiring a very precise and complex sequence and coordination among all the disciplines in the factory setting.

Volumetric modular construction is increasingly in high demand for construction projects such a multifamily apartments, hotels, schools, and other construction market segments in relatively high-density and high-cost labor markets. The advantages of volumetric modular construction include the ability to assemble portions of the final building, often referred to as modular units or volumetric modules, at an off-site factory location, with the completed volumetric modules transported to the building site and assembled together to form the final project. Since the assembly of the volumetric modules occurs off-site, all aspects of the assembly including mechanical, structural, electrical, plumbing, etc., can be carefully coordinated and controlled for each volumetric module, to increase the efficiency of module assembly, and to control the quality and build of the final product. Furthermore, multi-unit construction typically requires the coordination of multiple professional and trade construction disciplines such as architects, engineers, contractors, electricians, plumbers, cabinetmakers, building materials suppliers, etc. One key advantage of shifting conventional on-site construction of multifamily units to an off-site volumetric modular construction in a factory setting is the enhanced efficiency in hiring and coordinating of these disciplines within one company, thereby enhancing control over all disciplines and processes for the module fabrication and design.

Volumetric modular construction can provide additional advantages when combined with the economies-of-scale that result when each modular unit in a building is substantially identical. However, because external building façade and elevation selections can result in small variations from unit-to-unit, such economies-of-scale have been difficult to realize.

Therefore, there is a need for a modular construction system that provides for a select number of predefined modular building volumes that each contain a core location therein and that together form the building. Such a needed system would provide for any of a select number of predefined cores or units to be included in any of the volumes, thereby standardizing each core and volume. Such a needed construction system would provide for off-site fabrication of most of the building at a single location, economies-of-scale when fabricating the cores and volumes, even between different building projects, and that still provide a wide choice of building layouts, exterior façades, choice of building heights and levels, internal kits for outfitting each unit with appliances, fixtures, internal walls, and the like, and a variety of easily-connected utility services to each unit. The present invention accomplishes these objectives.

SUMMARY OF THE INVENTION

The present device is a modular building and methods of construction thereof, on a job site support surface. The job site support surface includes two or more supply lines, such as utility lines. The building comprises one or more volume templates determined by job site support surfacer requirements, or utilized from a list of predefined or previously-used such volume templates. Each volume template comprises two or more core locations, and a corridor, all bounded within a volume footprint. The one or more volume templates together define an exterior perimeter of the building.

A core for each core location of each volume template is selected form a core library of predefined such cores. Each core includes at least part of, for example, a living space, a stairwell, a utility room, or the like. Each core includes a base having a perimeter, a lower side adapted for resting on the job site support surface, and an upper side adapted for supporting a floor. Three or more core walls project upward from the floor about the perimeter of the base and define an interior space. A ceiling closes the interior space above the core walls. Each core wall is made from wood or metal studs covered with drywall or other suitable covering, as is known in the art.

Each core wall includes an inner side and an outer side. At least one of the core walls is designated as a service wall and encloses two or more service lines. Ideally at least one of the core walls, and the service wall in particular, include at least one shear panel fixed with the inner side thereof. As such the service lines of the service wall of each core are accessible from the corridor outside of the interior space and the shear panel of the core.

For each volume template, at least two exterior walls are designated as part of either the volume template or the one or more cores bound within the volume template. Each exterior wall has an exterior surface and an interior surface. The exterior surfaces of all of the exterior walls each include at least one attachment zone.

Each core of each volume template preferably includes either a doorway into the corridor, or a walkway into an adjacent core of an adjacent volume template. As such, multiple cores may be connected together in adjacent volumes and be connected to the corridor through only one of the cores. For example, a three bedroom residential unit can be constructed from three of the cores, a primary core having a primary doorway into the corridor, another, center core having one of the walkways into the primary core and another of the walkways into a third core.

Buildings having multiple levels of cores can be built by stacking volumes above each other and affixing such stacked volumes together with one of the stitch plates, oriented horizontally along a seam between the stacked volumes. As such, at least one of the cores in one of the volumes on each level includes a stairwell and optionally an elevator that provides access from the corridor of each level with the corridor of a next upper levels and a next lower levels.

A catalog of internal kits is included, each internal kit comprising a plurality of internal elements taken from the set of walls, appliances, cabinets, fixtures, windows, and doors. Each internal kit has an associated bill-of-materials comprising the internal elements and required building materials therefore.

A plurality of the stitch plates are included for mutually fixing the volumes together at the attachment zones on the job site support surface. The volumes may also be mutually affixed with additional brackets and hardware as deemed necessary by those assembling the building at the job site.

With a building method of the invention, each volume template and the selected cores and internal kits are constructed concurrently with the building materials at a manufacturing location. Once a volume is complete with the selected cores and the internal kits, the volume is transported to the job site support surface. Adjacent volumes are connected together with at least one of the stitch plates at the predefined attachment zones of the volumes. The service lines of each core are connected with the supply lines or to services lines of upper or lower volumes as appropriate.

Once the building is assembled, the builder or owner may determine exterior facades, roof styles, landscaping, and the like.

A method of manufacturing the building includes the following steps. First, the core library is defined, as well as the internal kit catalog. One or more of the volume templates is determined from previously-used or predefined volume templates, or based on specifications of the specific job site, and for each core location within each volume template one of the cores is selected from the core library. The internal kits for each core are also selected from the internal kit catalog.

As the building materials are obtained for the volume templates, cores, and internal kits, at the manufacturing location, the volume templates and cores are constructed concurrently, adding the internal elements of the selected internal kits. Assembling the volume templates, cores, and internal kits at a common manufacturing location provides economies-of-scale and reduces variances that result in additional building costs if built at the job site.

One a volume is completed, the volume is transported to the job site support surface where it is assembled with the other volumes together on the job site support surface by bolting the bases to the job site support surface through known attachment methods, and affixing adjacent volumes together with the stitch plates at the pre-defined attachment zones of the volumes. Then the service lines of each core are connected with the supply lines as appropriate.

The present invention is a modular construction building and method that provides for a select number of modular building volume templates that each contain the core locations therein and that together form the building. The present system provides for any of a select number of predefined cores or units to be included in any of the volume templates, thereby standardizing each core and volume template. The present invention provides for off-site fabrication of most of the building at a single location, economies-of-scale when fabricating the cores and volume templates, even between different building projects, and that still provides a wide choice of building layouts, choice of building heights and levels, internal unit selections, internal kits for outfitting each unit with appliances, fixtures, internal walls, and the like, and a variety of easily-connected utility services to each unit. Other features and advantages of the present invention will become apparent from the following more detailed description, taken in conjunction with the accompanying drawings, which illustrate, by way of example, the principles of the invention.

DESCRIPTION OF THE DRAWINGS

FIG. 1B is a top plan view of a volume template of the invention, illustrated without the cores loaded in;

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1A:
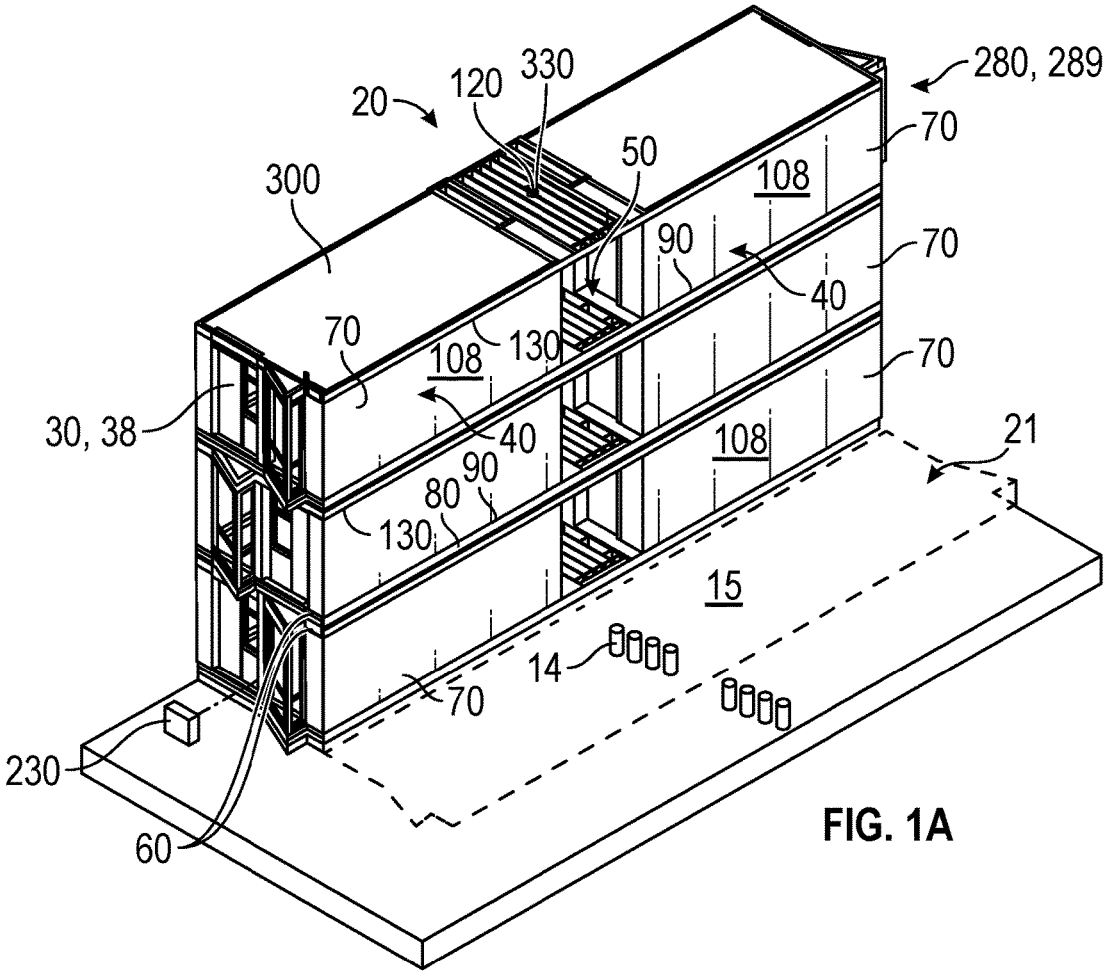
FIG. 1A is a perspective view of a stack of three volumes of the invention, each volume containing two cores.
Figure 1B:
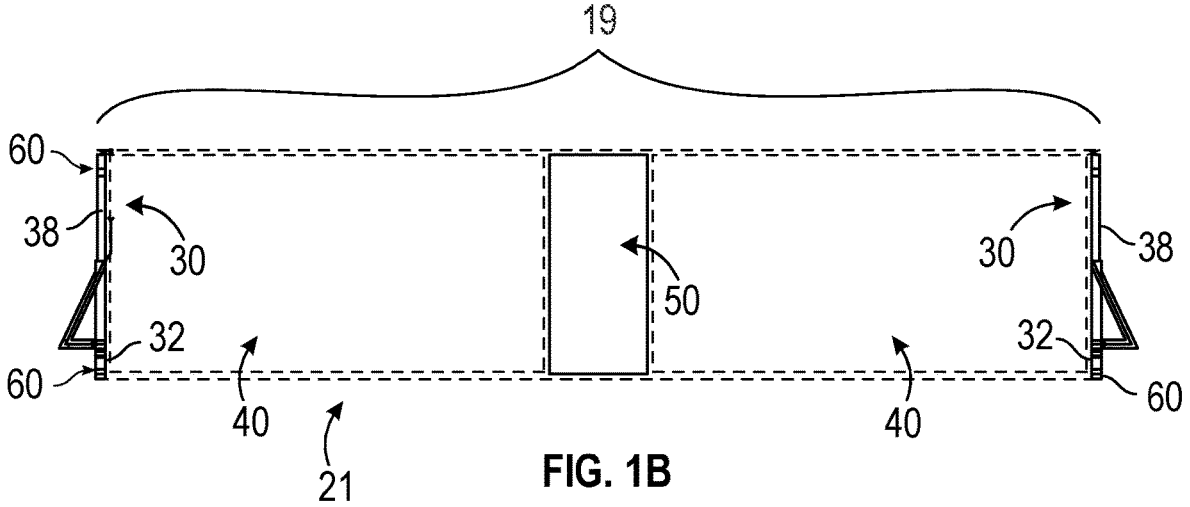
Figure 2:
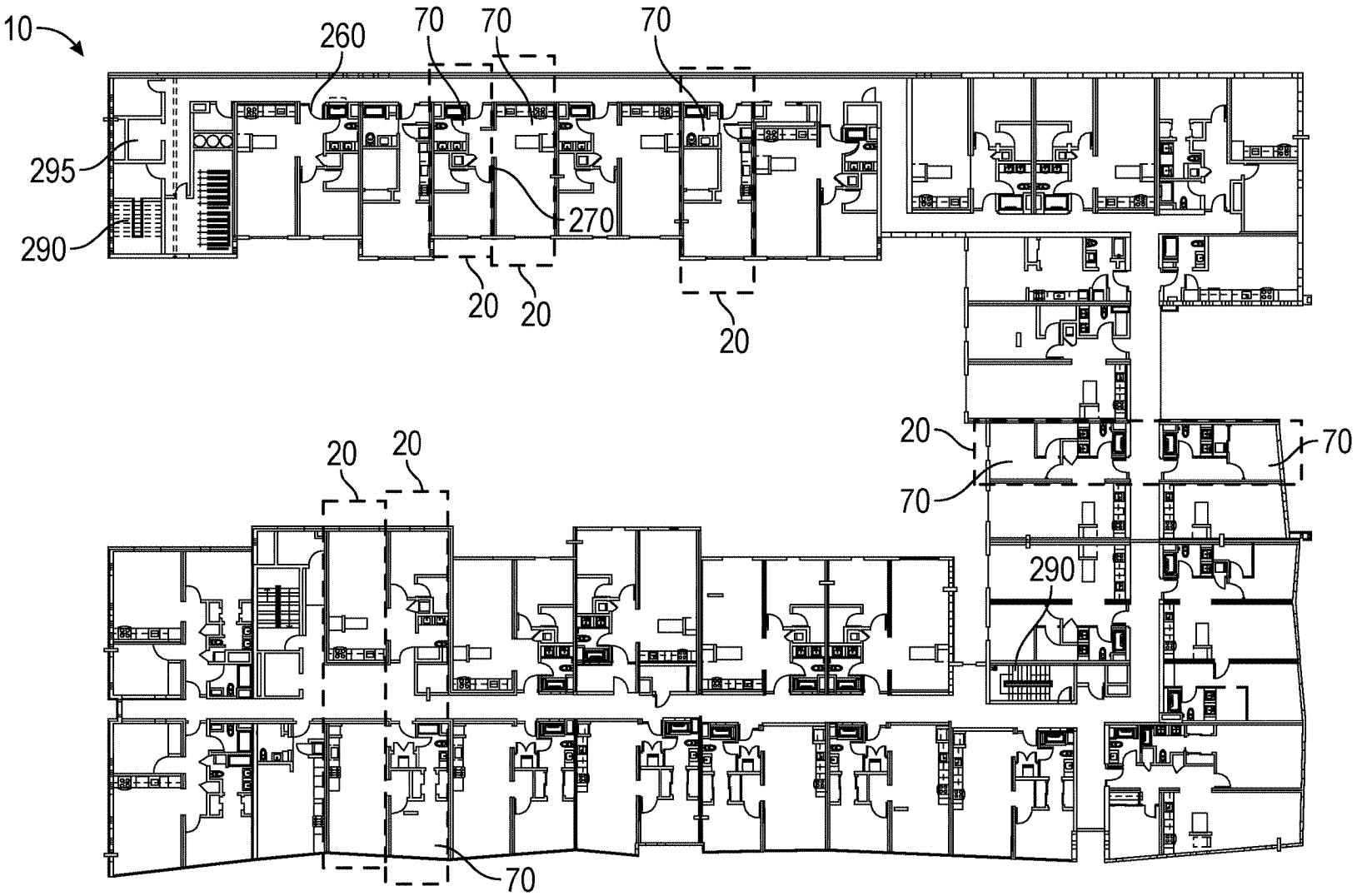
FIG. 2 is a top plan view of a building of the present invention.

FIGS. 1A, 1B and 2 illustrate a modular building 10 for a job site support surface 15, such as a slab, foundation, or the like. The job site support surface 15 includes two or more supply lines 14, such as water, natural gas, propane, sewer, cable, telephone, Internet, and the like. Such supply lines 14 are routed either into the job site support surface 15 from below or onto the job site support surface 15 from a side thereof.

Figure 3:
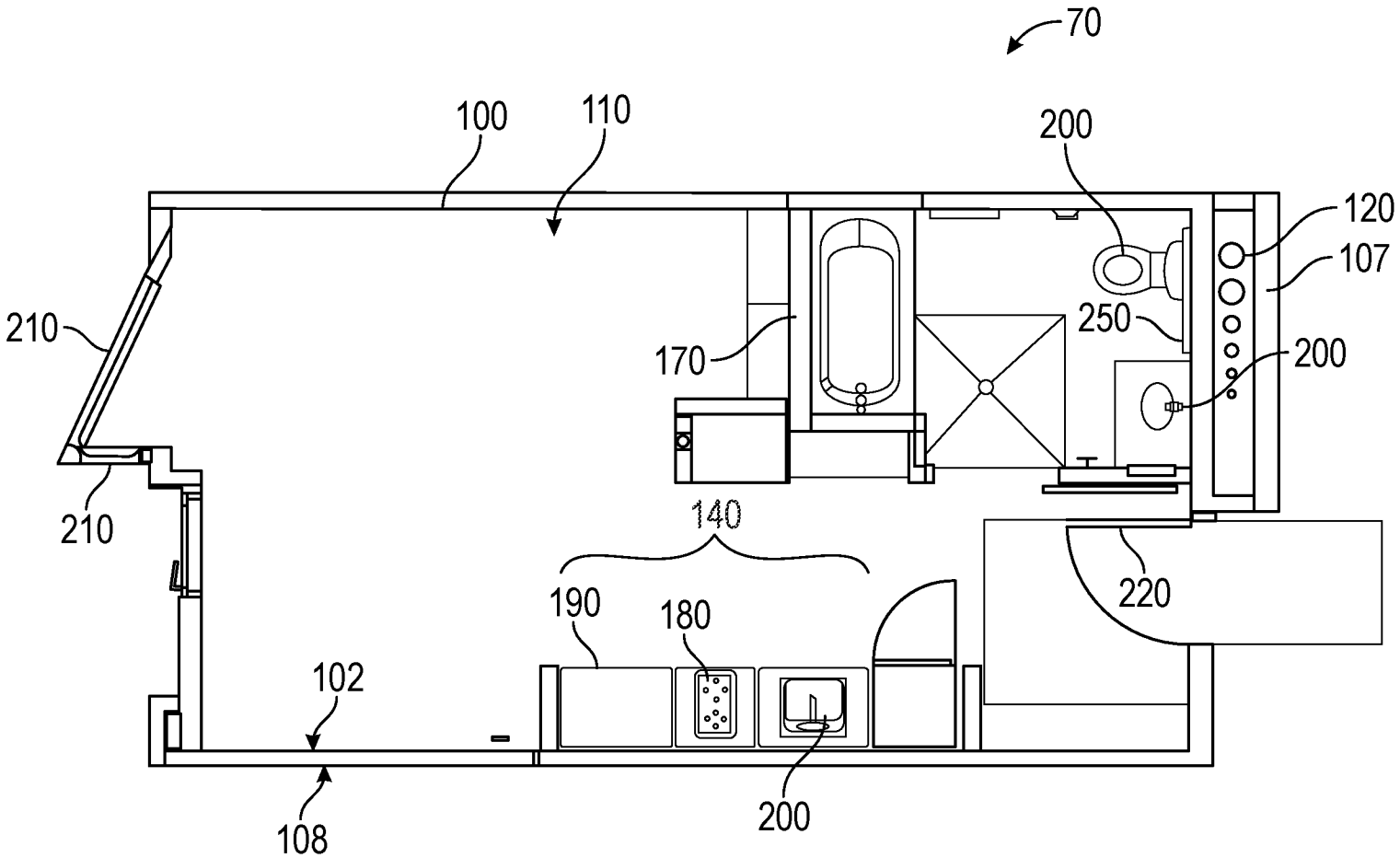
FIG. 3 is a top plan view of a core of the invention.

The building 10 comprises one or more volume templates 19 (FIG. 1B) that each comprise a corridor 50 and one or more core locations 40, all bounded within a volume footprint 21 (FIG. 1A). A core 70 (FIG. 3) for each core location 40 of each volume template 19 is selected form a core library 18 (FIG. 9) of predefined such cores 70, and when the volume template 19 is constructed with the one or more cores 70 and other elements listed below, a volume 20 is completed.

Figure 6:
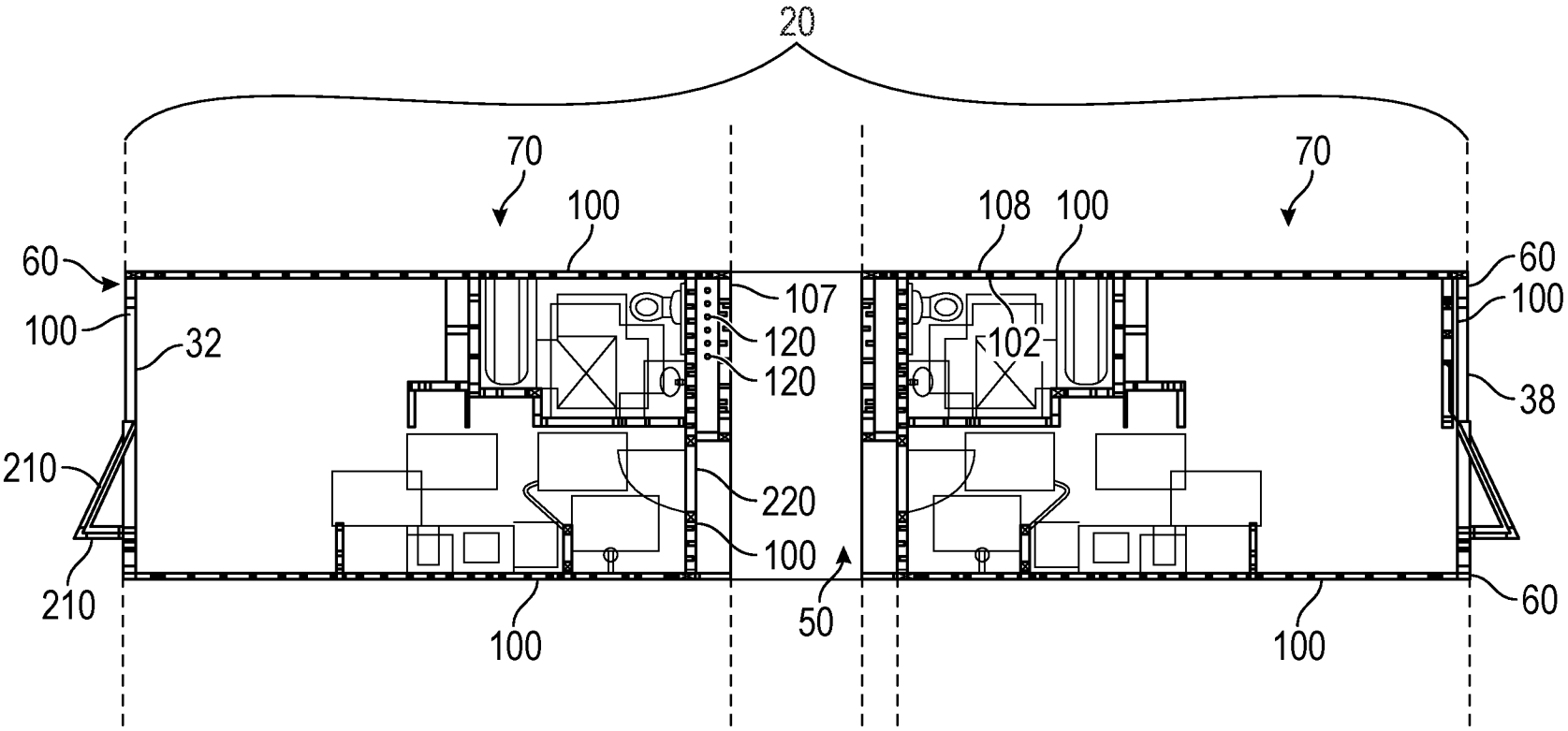
FIG. 6 is a top plan view of a volume showing two of the cores as fitted therein and separated by a corridor.
Figure 7:
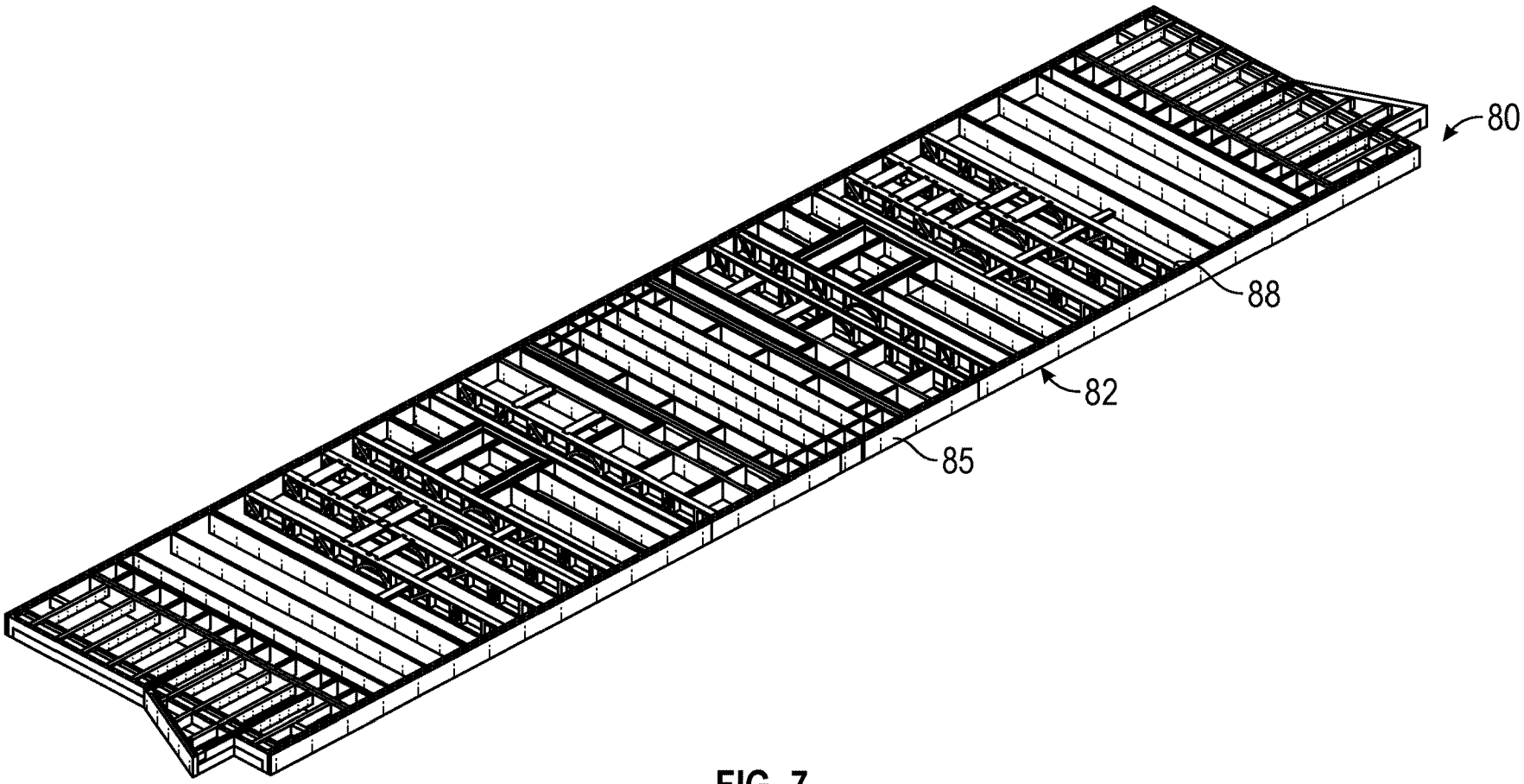
FIG. 7 is a perspective view of a base of a core.
Figure 8:
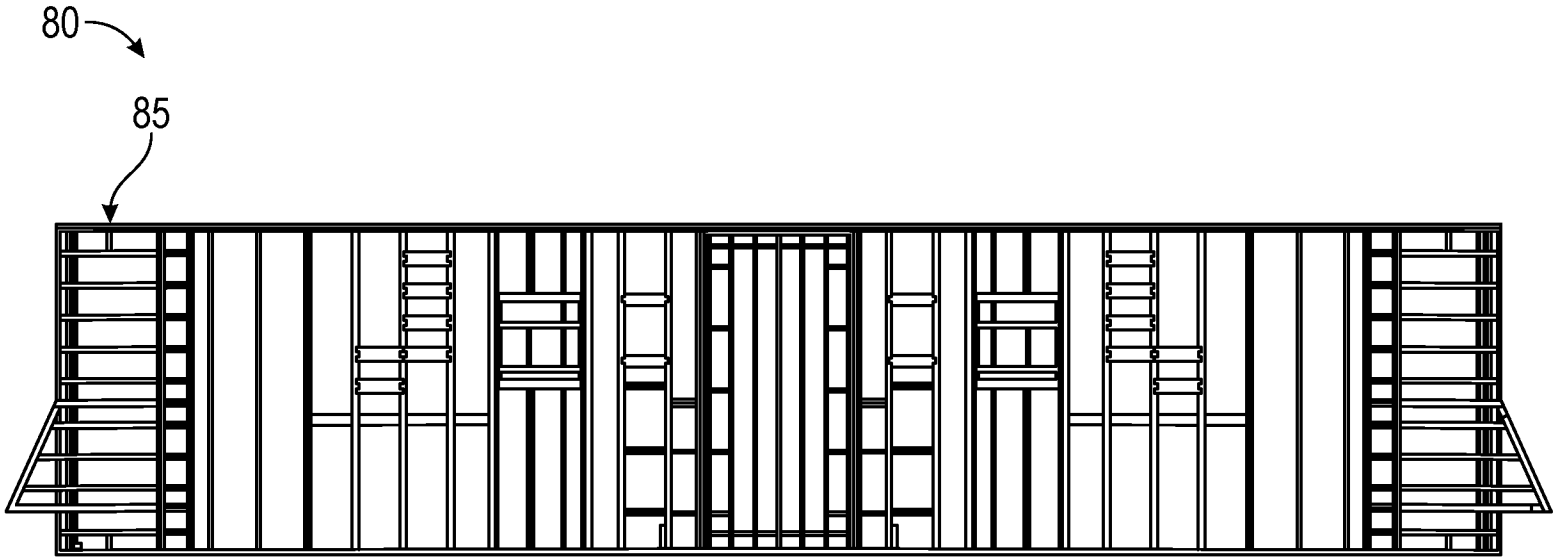
FIG. 8 is a top plan view of the base of FIG. 7.

Each core 70 includes a base 80 (FIGS. 7 and 8) having a perimeter 85, a lower side 82 adapted for resting on the job site support surface 15, and an upper side 88 adapted for supporting a floor 90. Three or more core walls 100 project upward from the floor 90 about the perimeter 85 of the base 80 and define an interior space 110. A ceiling 130 closes the interior space 110 above the core walls 100. Each core wall 100 is made from wood or metal studs 103 (FIG. 6) covered with drywall 104 or other suitable covering, as is known in the art.

Each core wall 100 includes an inner side 102 and an outer side 108. At least one of the core walls 100 is designated as a service wall 107 and encloses two or more service lines 120. Ideally at least one of the core walls 100, and the service wall 107 in particular, include at least one shear panel 250 fixed with the inner side 102 thereof. As such the service lines 120 of the service wall 107 of each core 70 are accessible from the corridor 50 outside of the interior space 110 and the shear panel 250 of the core 70.

Figure 10:
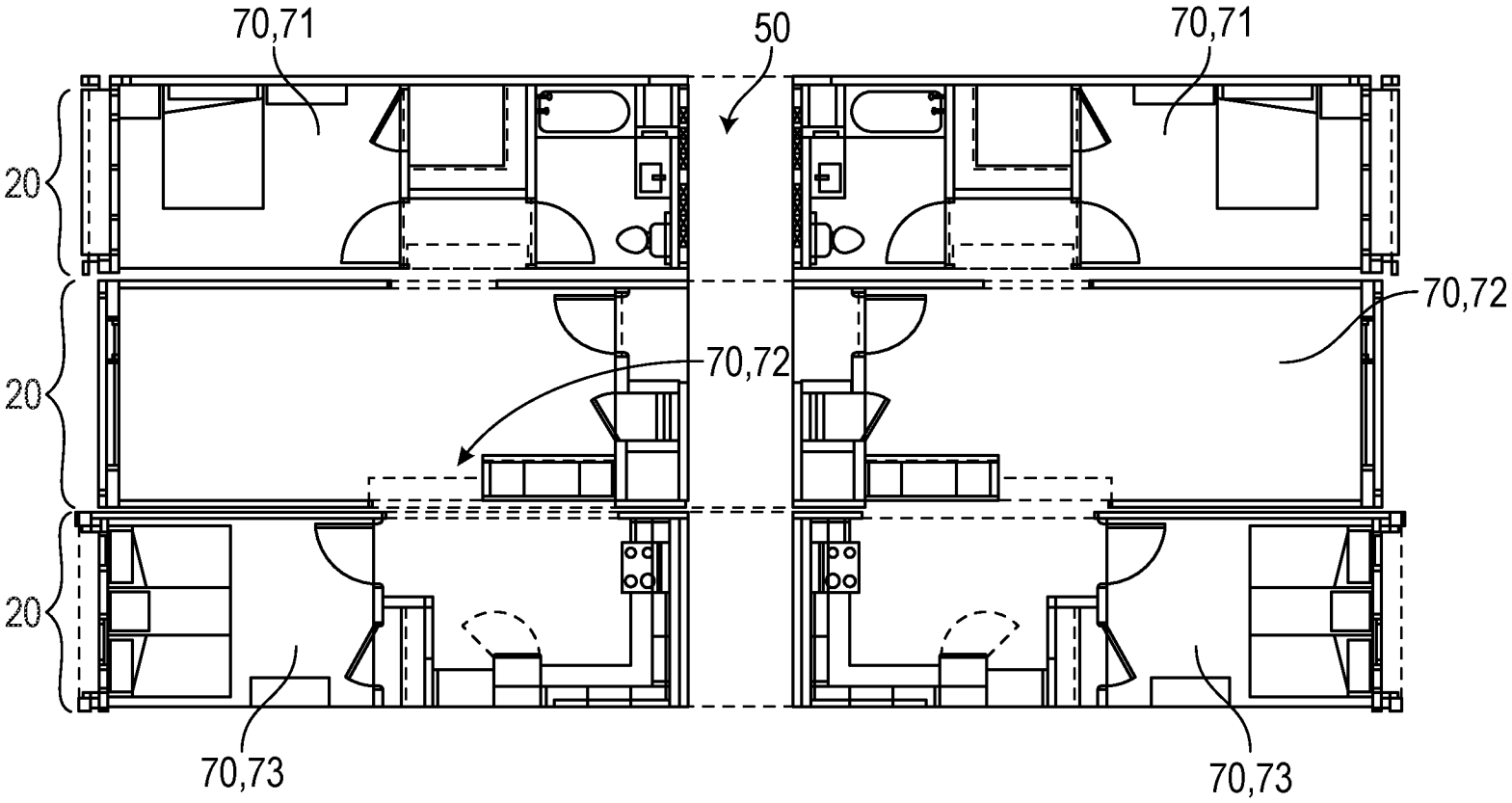
FIG. 10 is a top plan view of an example of three adjacent volumes each comprising portions of two 2-bedroom residential units separated by the corridor.

Each core 70 of each volume 20 preferably includes either a doorway 260 (FIGS. 2 and 10) into the corridor 50, or a walkway 270 into an adjacent core 70 of an adjacent volume 20. As such, multiple cores 70 may be connected together in adjacent volumes 20 and be connected to the corridor 50 through only one of the cores 70. For example, a three bedroom residential unit can be constructed from three of the cores 70, a primary core 71 having a primary doorway 260 into the corridor 50, another, center core 72 having one of the walkways 270 into the primary core 71 and another of the walkways 270 into a third core 73.

For each volume template 19, at least two exterior walls 30 are designated as part of either the volume template 19 or the one or more cores 70 bound within the volume template 19. Each exterior wall 30 has an exterior surface 38 and an interior surface 32. The exterior surfaces 38 of all of the exterior walls 30 each include at least one attachment zone 60.

Buildings 10 having multiple levels 280 (FIG. 1A) of cores 70 can be built by stacking volumes 20 above each other and affixing such stacked volumes 20 together with one of the stitch plates 230, oriented horizontally along a seam between the stacked volumes 20. As such, at least one of the cores 70 in one of the volumes 20 on each level includes a stairwell 290 (FIG. 2) that provides access from the corridor 50 of each level 280 with the corridor 50 of a next upper level 280 and a next lower level 280. A core 70 having one or more elevators 295, optionally combined with the stairwell 290, may also be included.

A roof 300 (FIG. 1A) is defined above a top-most level 289 of the cores 70. Once assembled, the builder or owner of the building 10 may direct rain water, through any of several methods known in the art, from the roof 300 to a drain 330 positioned to receive the rain and to drain the rain through one of the service lines 120 of the service walls 107 of one or more of the cores 70.

Figure 4:
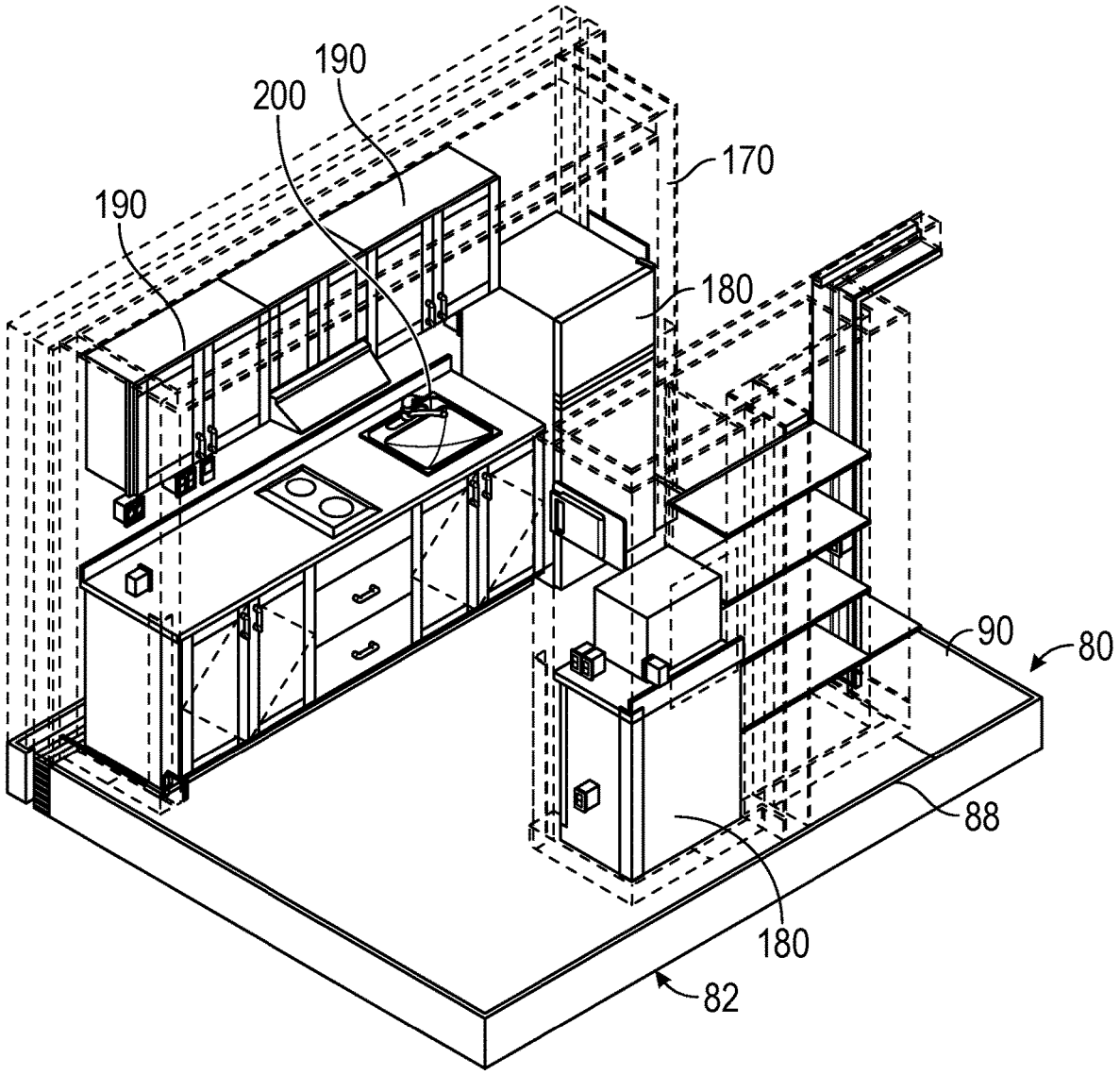
FIG. 4 is a partial perspective view of a kitchen area of one of the cores.

A catalog 16 of internal kits 140 is included, each internal kit 140 comprising a plurality of internal elements 150 (FIG. 4) taken from the set of walls 170, appliances 180, cabinets 190, fixtures 200, windows 210, and doors 220. Each internal kit 140 has an associated bill-of-materials 155 comprising the internal elements 150 and required building materials 160 therefore.

A plurality of the stitch plates 230 are included for mutually fixing the volumes 20 together at the attachment zones 60 on the job site support surface 15. The volumes 20 may also be mutually affixed with additional brackets and hardware (not shown) as deemed necessary by those assembling the building 10 at the job site 15.

Figure 5:
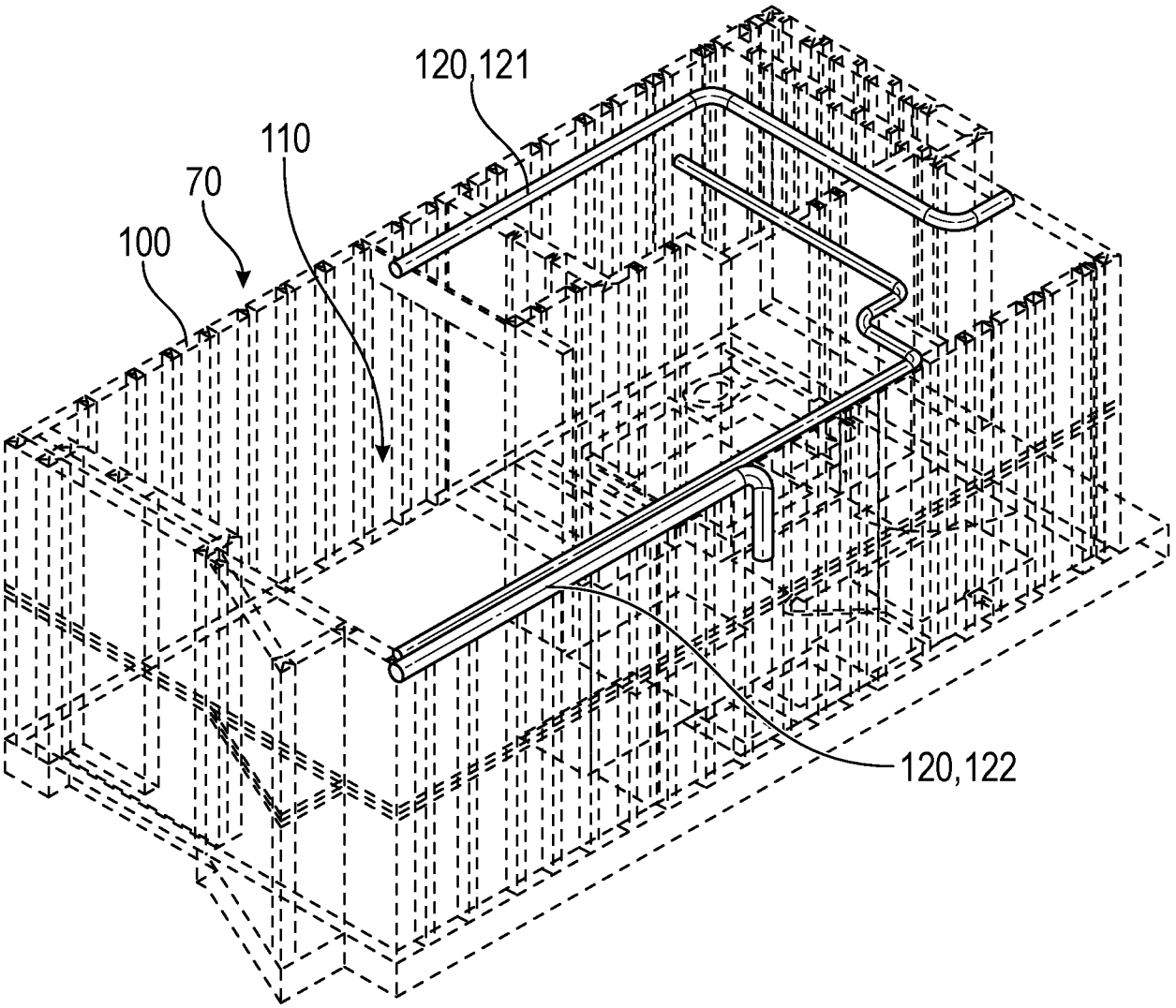
FIG. 5 is a partially transparent perspective view showing air service lines of the present invention.
Figure 9:
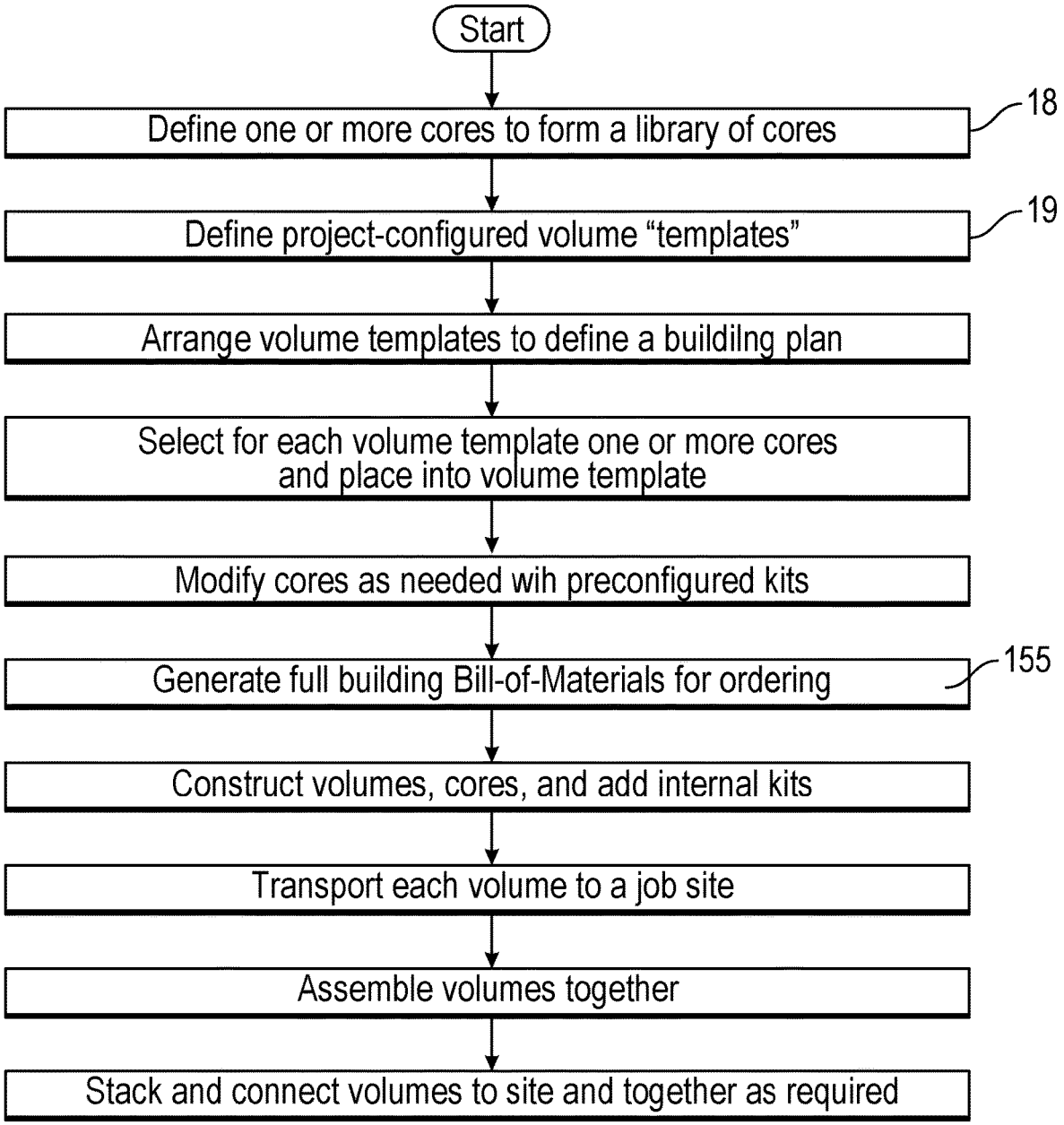
FIG. 9 is a flow-chart showing a method of the present invention.

With a building method of the invention, illustrated in FIG. 9, each volume 20 and the selected cores 70 and internal kits 140 are constructed concurrently with the building materials 160. Once a volume 20 is complete with the selected cores 70 and the internal kits 140, the volume 20 is transported to the job site support surface 15. Adjacent volumes 20 are connected together with at least one of the stitch plates 230 at the predefined attachment zones 60 of the volumes 20. The service lines 120 of each core 70 are connected with the supply lines 14 or to services lines 120 of upper or lower volumes 20 as appropriate. In some embodiments, at least one of the service lines 120 is an air balancing line 121 (FIG. 5) connecting the interior space 110 of the core 70 with the corridor 50, optionally through an air balancing dampener (not shown) so as to reduce pressure disturbances when closing a door 220 between the interior space 110 and the corridor 50. Another of the service lines 120 is at least one air vent 122 (FIG. 5) for venting air from a bathroom or kitchen area through the outer wall 30 of the volume 20 and core 70.

A method of manufacturing the building 10 includes the following steps. First, the core library 18 is defined, as well as the internal kit catalog 16. One or more of the volume templates 19 are determined from job site parameters or from previously-used volume templates 19. For each core location 40 within each volume template 19 one of the cores 70 is selected from the core library 18. The internal kits 140 for each core 70 are also selected from the internal kit catalog 16.

As the building materials 160 are obtained for the volumes 20, cores 70, and internal kits 140, and collected at a manufacturing location (not shown), the volumes 20 are constructed with the volume templates 19 and cores 70, adding the internal elements 150 of the selected internal kits 140.

Once a volume 20 is completed, the volume 20 is transported to the job site support surface 15 where it is assembled with the other volumes 20 together on the job site support surface 15 by bolting the bases 80 to the job site support surface 15 through known attachment methods, and affixing adjacent volumes 20 together with the stitch plates 230 at the pre-defined attachment zones 60 of the volumes 20. Then the service lines 120 of each core 70 are connected with the supply lines 14 as appropriate. An external façade (not shown), landscaping (not shown), roof panels or treatments (not shown) and the like can be added by the building owner or builder as desired.

While a particular form of the invention has been illustrated and described, it will be apparent that various modifications can be made without departing from the spirit and scope of the invention. For example, the specific volumes 20 and cores 70 illustrated are for example only, and any number of different volume and corresponding core shapes may be utilized. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A method for fabricating a building on a job site support surface having two or more supply lines, comprising the steps:

defining a core library of two or more cores, each core comprising:

a base having a perimeter, a lower side adapted for resting on the job site support surface, and an upper side adapted for supporting a floor;

three or more core walls projecting upward from the floor about the perimeter of the base and defining an interior space, each core wall including an inner side and an outer side, at least one of the core walls being a service wall enclosing two or more service lines;

a ceiling closing the interior space above the core walls;

a plurality of internal kits, each comprising a plurality of internal elements taken from the set of walls, appliances, cabinets, fixtures, windows, and doors, and each internal kit having an associated bill-of-materials comprising the internal elements;

adding at least one shear panel to the inner side of the service wall of each core;

providing direct access to the service lines of one of the cores from the corridor;

defining two or more volume templates each including one or more core locations and a corridor, each core location being adapted to receive any of the cores in the core library within;

defining at least two exterior walls per volume, the at least two exterior walls designated as part of either the volume template or the one or more cores bound within the volume template, each exterior wall having an exterior surface and an interior surface; and defining a plurality of stitch plates for mutually fixing the volumes together on the job site support surface at attachment zones of the exterior walls;

selecting one or more of the volume templates that together define an exterior perimeter of the building;

selecting for each volume template two or more of the cores and internal kits;

obtaining building materials for the volume templates, cores, and internal kits;

constructing the volume templates and cores bound within the volume templates concurrently and adding the internal elements of the selected internal kits to complete a volume;

transporting each completed volume to the job site support surface; and assembling the volumes together on the job site support surface, connecting adjacent volumes together with at least one stitch plate at the pre-defined attachment zones of the volumes, and connecting the service lines of each core with the supply lines.

2. The method of claim 1 further including the step:

providing for each core of each volume template either a doorway into the corridor or a walkway into an adjacent core in an adjacent volume template.

3. A building obtained by the method for fabricating a building of claim 2.

4. The method of claim 1 further including the steps:

providing a stairwell with at least two of the cores, and providing multiple levels of cores, each stairwell providing access from the corridor of each level with the corridor of a next upper level and a next lower level; and connecting the service lines of each core with the service lines of a next upper core and/or a next lower core.

5. A building obtained by the method for fabricating a building of claim 4.

6. A building obtained by the method for fabricating a building of claim 1.

7. A building for a job site support surface having two or more supply lines, comprising:

one or more volume templates, each volume template comprising one or more core locations and a corridor all bounded within in a volume footprint, the one or more volume templates together defining an exterior perimeter of the building;

a core for each core location of each volume template, each core selected from a core library having a plurality of available cores that each include:

a base having a perimeter, a lower side adapted for resting on the job site support surface, and an upper side adapted for supporting a floor;

three or more core walls projecting upward from the floor about the perimeter of the base and defining an interior space, each core wall including an inner side and an outer side, at least one of the core walls being a service wall enclosing two or more service lines;

a ceiling closing the interior space above the core walls; and a plurality of internal kits, each comprising a plurality of internal elements taken from the set of walls, appliances, cabinets, fixtures, windows, and doors, and each internal kit having an associated bill-of-materials comprising the internal elements and required building materials therefore;

at least two exterior walls designated as part of either the volume template or the one or more cores bound within the volume template, each exterior wall having an exterior surface and an interior surface; and a plurality of stitch plates for mutually fixing the volumes together on the job site support surface at attachment zones of the exterior walls;

wherein each volume template, the selected cores, and internal kits are constructed concurrently with the building materials to form a completed volume, each completed volume transported to the job site support surface, adjacent volumes being connected together with at least one of the stitch plates at the pre-defined attachment zones of the external walls, service lines of each core being connected with the supply lines;

wherein the service wall includes at least one shear panel fixed with the inner side thereof; and wherein the service lines of the service wall of each core are accessible from the corridor outside of the interior space and the shear wall of the core.

8. The building of claim 7 wherein at least one of the core walls includes at least one shear panel fixed with the inner side thereof.

9. The building of claim 7 wherein each core of each volume includes either a doorway into the corridor or a walkway into an adjacent core of an adjacent volume.

10. The building of claim 7 including multiple levels of cores, at least one of the cores in one of the volumes on each level including a stairwell, the stairwell providing access from the corridor of each level with the corridor of a next upper level and a next lower level, the service lines of each core being connected with the service lines of a next upper core and/or a next lower core.

11. A building for a job site support surface having two or more supply lines, comprising:

one or more volume templates, each volume template comprising one or more core locations and a corridor all bounded within in a volume footprint, the one or more volume templates together defining an exterior perimeter of the building;

a core for each core location of each volume template, each core selected from a core library having a plurality of available cores that each include:

a base having a perimeter, a lower side adapted for resting on the job site support surface, and an upper side adapted for supporting a floor;

three or more core walls projecting upward from the floor about the perimeter of the base and defining an interior space, each core wall including an inner side and an outer side, at least one of the core walls being a service wall enclosing two or more service lines;

a ceiling closing the interior space above the core walls;

at least one shear panel fixed with the inner side of the service wall, wherein the service lines of the service wall of each core are accessible from the corridor outside of the interior space and the shear wall of the core; and a plurality of internal kits, each comprising a plurality of internal elements taken from the set of walls, appliances, cabinets, fixtures, windows, and doors, and each internal kit having an associated bill-of-materials comprising the internal elements and required building materials therefore;

wherein each volume template, the selected cores, and internal kits are constructed concurrently with the building materials to form a completed volume, each completed volume transported to the job site support surface.

12. The building of claim 11 wherein each core of each volume includes either a doorway into the corridor or a walkway into an adjacent core of an adjacent volume.

13. The building of claim 11 including multiple levels of cores, at least one of the cores in one of the volumes on each level including a stairwell, the stairwell providing access from the corridor of each level with the corridor of a next upper level and a next lower level, the service lines of each core being connected with the service lines of a next upper core and/or a next lower core.

* * * * *